US010336076B2

(12) United States Patent
Seki et al.

(10) Patent No.: US 10,336,076 B2
(45) Date of Patent: Jul. 2, 2019

(54) LIQUID EJECTING APPARATUS

(71) Applicant: SEIKO EPSON CORPORATION, Tokyo (JP)

(72) Inventors: Takanori Seki, Suwa (JP); Hitotoshi Kimura, Matsumoto (JP); Takayuki Kawakami, Matsumoto (JP); Tatsuya Nakano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/905,433

(22) Filed: Feb. 26, 2018

(65) Prior Publication Data

US 2018/0244045 A1 Aug. 30, 2018

(30) Foreign Application Priority Data

Feb. 27, 2017 (JP) ..... 2017-034471

(51) Int. Cl.
*B41J 2/165* (2006.01)
*B41J 2/17* (2006.01)
(Continued)

(52) U.S. Cl.
CPC ..... *B41J 2/16511* (2013.01); *B41J 2/16508* (2013.01); *B41J 2/16517* (2013.01); *B41J 2/16526* (2013.01); *B41J 2/1707* (2013.01); *B41J 2/1721* (2013.01); *B41J 29/17* (2013.01); *B41M 7/0018* (2013.01); *B41J 2002/1742* (2013.01); *B41M 5/0017* (2013.01); *B41P 2235/10* (2013.01)

(58) Field of Classification Search
CPC .... B41J 2/16511; B41J 2/1721; B41J 2/1702; B41J 2002/1742; B41J 29/17; B41M 7/0018; B41P 2235/10
See application file for complete search history.

(56) References Cited

U.S. PATENT DOCUMENTS 5,617,124 A 4/1997 Taylor et al.
2007/0052739 A1 3/2007 Matsuhashi
(Continued)

FOREIGN PATENT DOCUMENTS

JP 07-276657 A 10/1995
JP 2001-162836 A 6/2001
(Continued)

*Primary Examiner* — Sharon A. Polk
(74) *Attorney, Agent, or Firm* — Workman Nydegger

(57) ABSTRACT

A liquid ejecting apparatus includes a liquid ejecting unit that can eject a first liquid and a second liquid to a medium, a first rotating body having a circumferential surface that can receive the first liquid ejected from the liquid ejecting unit, a first sliding contact member that can be slidably in contact with the circumferential surface of the first rotating body, a first collection unit that collects the first liquid that is collected from the circumferential surface by the first sliding contact member, a second rotating body having a circumferential surface that can receive the second liquid ejected from the liquid ejecting unit, a second sliding contact member that can be slidably in contact with the circumferential surface of the second rotating body, and a second collection unit that collects the second liquid that is collected from the circumferential surface by the second sliding contact member.

17 Claims, 9 Drawing Sheets

(51) Int. Cl.

| | |
|---|---|
| ***B41M 7/00*** | (2006.01) |
| ***B41J 29/17*** | (2006.01) |
| *B41M 5/00* | (2006.01) |

(56) References Cited

U.S. PATENT DOCUMENTS

| | | | |
|---|---|---|---|
| 2008/0079772 | A1 | 4/2008 | Kojima |
| 2014/0184690 | A1 | 7/2014 | Miyamoto et al. |
| 2014/0253632 | A1* | 9/2014 | Matsumoto ..... B41J 2/1652 347/33 |
| 2015/0062239 | A1 | 3/2015 | Wakabayashi et al. |

FOREIGN PATENT DOCUMENTS

| | | | |
|---|---|---|---|
| JP | 2005-319650 | A | 11/2005 |
| JP | 2007-062339 | | 3/2007 |
| JP | 2007-283634 | A | 11/2007 |
| JP | 2008-080731 | A | 4/2008 |
| JP | 2008-229919 | A | 10/2008 |
| JP | 2011-088308 | A | 5/2011 |
| JP | 2011-126062 | A | 6/2011 |
| JP | 2011-156781 | A | 8/2011 |
| JP | 2011-161690 | A | 8/2011 |
| JP | 2011-230343 | A | 11/2011 |
| JP | 2013-139132 | A | 7/2013 |
| JP | 2014-124875 | A | 7/2014 |
| JP | 2015-044356 | A | 3/2015 |

* cited by examiner

Z

LIQUID EJECTING APPARATUS

BACKGROUND

1. Technical Field

The present invention relates to a liquid ejecting apparatus such as, for example, an ink jet type printer.

2. Related Art

A liquid ejecting apparatus has been known which prints an image on a medium by ejecting liquid from a head to the medium. In such a liquid ejecting apparatus, flushing may be performed where liquid that is not used for printing is ejected from the head in order to maintain or recover ejection performance of the head.

As an example of a liquid ejecting apparatus, JP-A-2008-229919 describes an image forming apparatus that includes an idle discharge receiving unit that collects liquid ejected by flushing. The idle discharge receiving unit includes a rotary body on which liquid ejected from a head lands, a scraping member that scrapes the liquid attached to a circumferential surface of the rotary body, and a waste liquid container that contains the liquid scraped by the scraping member.

Among liquid ejecting apparatuses, there is a liquid ejecting apparatus that ejects a plurality of types of liquids whose characteristics are different from each other. For example, there is a liquid ejecting apparatus that ejects two types of liquids, which are ink and a post-treatment liquid. The liquid ejecting apparatus ejects the post-treatment liquid after ejecting the ink to a medium in order to facilitate fixing of the ink ejected to the medium. In the case of the liquid ejecting apparatus, when a plurality of types of liquids whose characteristics are different from each other are ejected to the idle discharge receiving unit, the liquids chemically react with each other in the idle discharge receiving unit, and solidification, thickening, and the like of the liquids occur, so that there is a risk of damaging the function of the idle discharge receiving unit.

SUMMARY

An advantage of some aspects of the invention is to provide a liquid ejecting apparatus that can properly perform flushing even when ejecting a plurality of liquids.

Hereinafter, an aspect of the invention and the effects thereof will be described. The liquid ejecting apparatus includes a liquid ejecting unit that can eject a first liquid and a second liquid to a medium, a first collection unit that collects the first liquid ejected from the liquid ejecting unit, and a second collection unit that collects the second liquid ejected from the liquid ejecting unit.

According to this configuration, the first liquid is collected by the first collection unit, and the second liquid is collected by the second collection unit. Therefore, it is possible to properly perform flushing even when ejecting a plurality of liquids.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
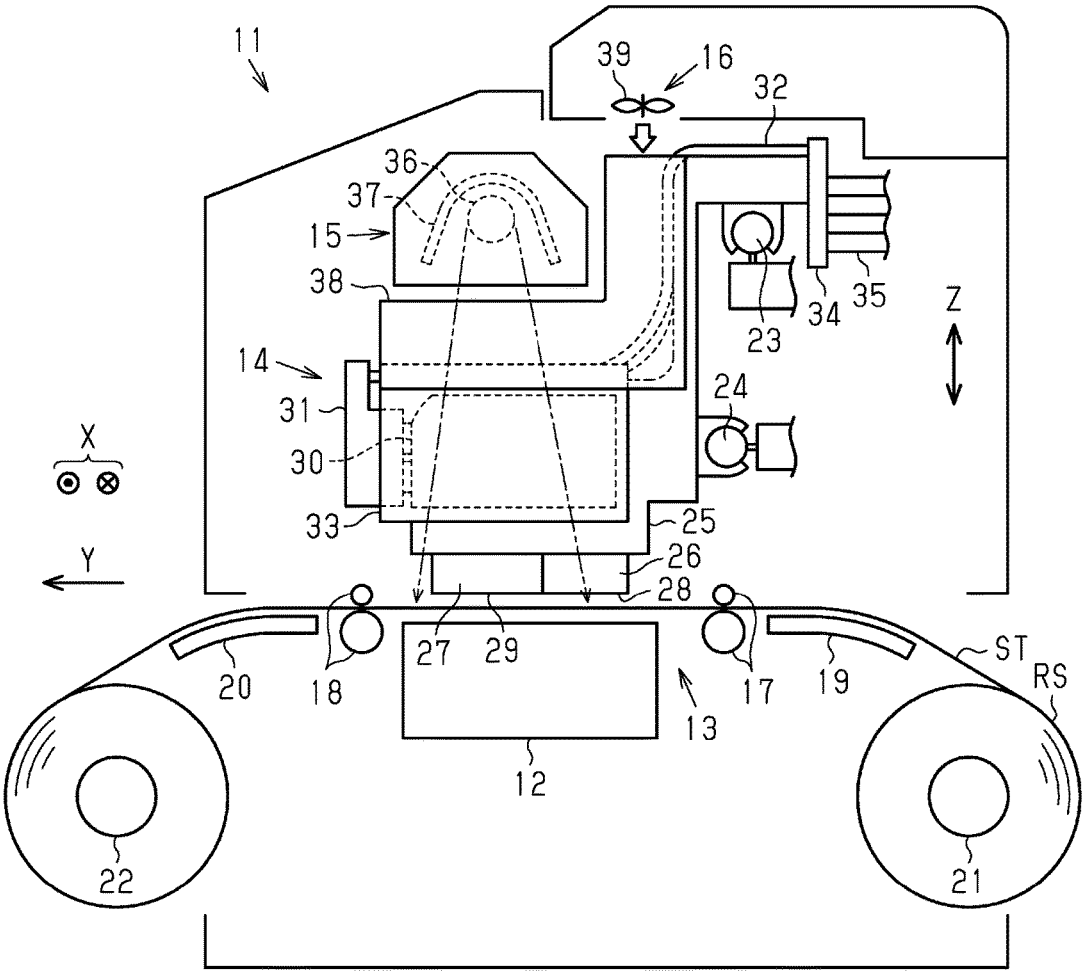
FIG. 1 is a side view schematically showing an embodiment of a liquid ejecting apparatus.

Hereinafter, an embodiment of a liquid ejecting apparatus will be described with reference to the drawings. As shown in FIG. 1, the liquid ejecting apparatus 11 includes a support table 12 that supports a medium ST and a transport unit 13 that transports the medium ST in a transport direction Y along a surface of the support table 12. The liquid ejecting apparatus 11 includes a liquid ejecting unit 14 that ejects liquid to the medium ST that is transported by the transport unit 13, and a heat generating unit 15 and an air blowing unit 16 for drying liquid attached to the medium ST.

The support table 12 is lengthily provided in a width direction X crossing a transport direction Y in a horizontal plane and supports the medium ST from below in a vertical direction Z. The transport unit 13 has transport roller pairs 17 and 18 that are arranged separately to an upstream side position and a downstream position of the support table 12 in the transport direction Y. In the transport direction Y, a guide plate 19 is arranged on an upstream side of the transport roller pair 17 and a guide plate 20 is arranged on a downstream side of the transport roller pair 18. The transport roller pairs 17 and 18 rotate while sandwiching the medium ST, so that the transport roller pairs 17 and 18 transport the medium ST along surfaces of the guide plates 19 and 20.

The liquid ejecting unit 14 is arranged above the support table 12 and faces the surface of the support table 12. The liquid ejecting unit 14 ejects liquid to the medium ST supported by the support table 12 and prints an image such as characters and photographs on the medium ST. In the present embodiment, the medium ST is formed of, for example, a paper sheet. The medium ST is unwound from a rolled paper sheet RS where the medium ST is wound around a supply reel 21 in a rolled state, and thereby transported in a continuous paper sheet state. The medium ST is printed by the liquid ejecting unit 14 and then wound in a rolled state again by a winding reel 22.

The liquid ejecting apparatus 11 has guide shafts 23 and 24 extending in the width direction X of the medium ST. The liquid ejecting unit 14 has a carriage 25 supported by the guide shafts 23 and 24. The carriage 25 can reciprocate in the with direction by a driving source not shown in the drawings. The liquid ejecting unit 14 has a first liquid ejecting head 26 and a second liquid ejecting head 27 that eject liquids whose characteristics are different from each other. The first liquid ejecting head 26 is configured to be able to eject a first liquid, and the second liquid ejecting head 27 is configured to be able to eject a second liquid that is liquid different from the first liquid. In the present embodiment, the first liquid is a treatment liquid that facilitates fixing of the second liquid to the medium ST. In the present embodiment, the second liquid is, for example, a water-based ink where a solvent contains water. Specifically, the first liquid is attached to the medium ST earlier than the second liquid, and thereby the fixing of the second liquid to the medium S is facilitated.

The first and the second liquid ejecting heads 26 and 27 are mounted on the carriage 25 so as to face the support table 12, and lower surfaces that face the support table 12 are nozzle forming surfaces 28 and 29. The first and the second liquid ejecting heads 26 and 27 are arranged so that positions thereof are shifted from each other in the transport direction Y. In the present embodiment, the first liquid ejecting head 26 is arranged more upstream than the second liquid ejecting head 27 in the transport direction Y. In other words, the first liquid ejecting head 26 is arranged so that liquid is ejected to the first liquid ejecting head 26 earlier than to the second liquid ejecting head 27.

The liquid ejecting unit 14 has an ink storage portion 30 that store the first and the second liquids to be supplied to the first and the second liquid ejecting heads 26 and 27. The liquid ejecting unit 14 has a connection tube 32 that supplies the first and the second liquids to the storage portion 30 through a flow path adaptor 31. The storage portion 30 is provided for each type of liquid ejected by the liquid ejecting unit 14, and in the present embodiment, two or more storage portions 30 are provided so as to correspond to at least first and the second liquids. The storage portion 30 is held by a holding portion 33 attached to the carriage 25. The flow path adaptor 31 is connected to a downstream side end portion of the connection tube 32. An upstream side end portion of the connection tube 32 is connected to a downstream side end portion of a supply tube 35 through a connection portion 34 provided to the carriage 25. The supply tube 35 is provided to be able to be deformed following the movement of the carriage 25. An upstream side end portion of the supply tube 35 is connected to a liquid containing body which contains liquid and is not shown in the drawings.

The heat generating unit 15 is arranged so as to face the support table 12 with the liquid ejecting unit 14 in between in the vertical direction Z. The heat generating unit 15 is lengthily provided in the width direction X so as to corresponds to the support table 12. The heat generating unit 15 includes a heat generating body 36 and a reflecting plate 37. The heat generating unit 15 is constituted by, for example, an infrared heater, and generates infrared heat. The heat generating unit 15 heats the medium ST supported by the support table 12 by infrared ray emitted from the heat generating body 36 and radiant heat reflected by the reflecting plate 37 as shown by chain line arrows in FIG. 1. Thereby, the heat generating unit 15 facilitates drying of the liquid attached to the medium ST. The carriage 25 has a shielding member 38 for shielding the heat from the heat generating unit 15 on an upper surface thereof. The shielding member 38 is formed of, for example, a metal material such as stainless steel or aluminum. The air blowing unit 16 has an air blowing fan 39 for blowing air to the medium ST supported by the support table 12. The air blowing unit 16 diffuses liquid vaporized by the heat generating unit 15 and facilitates drying of the liquid.

Figure 2:
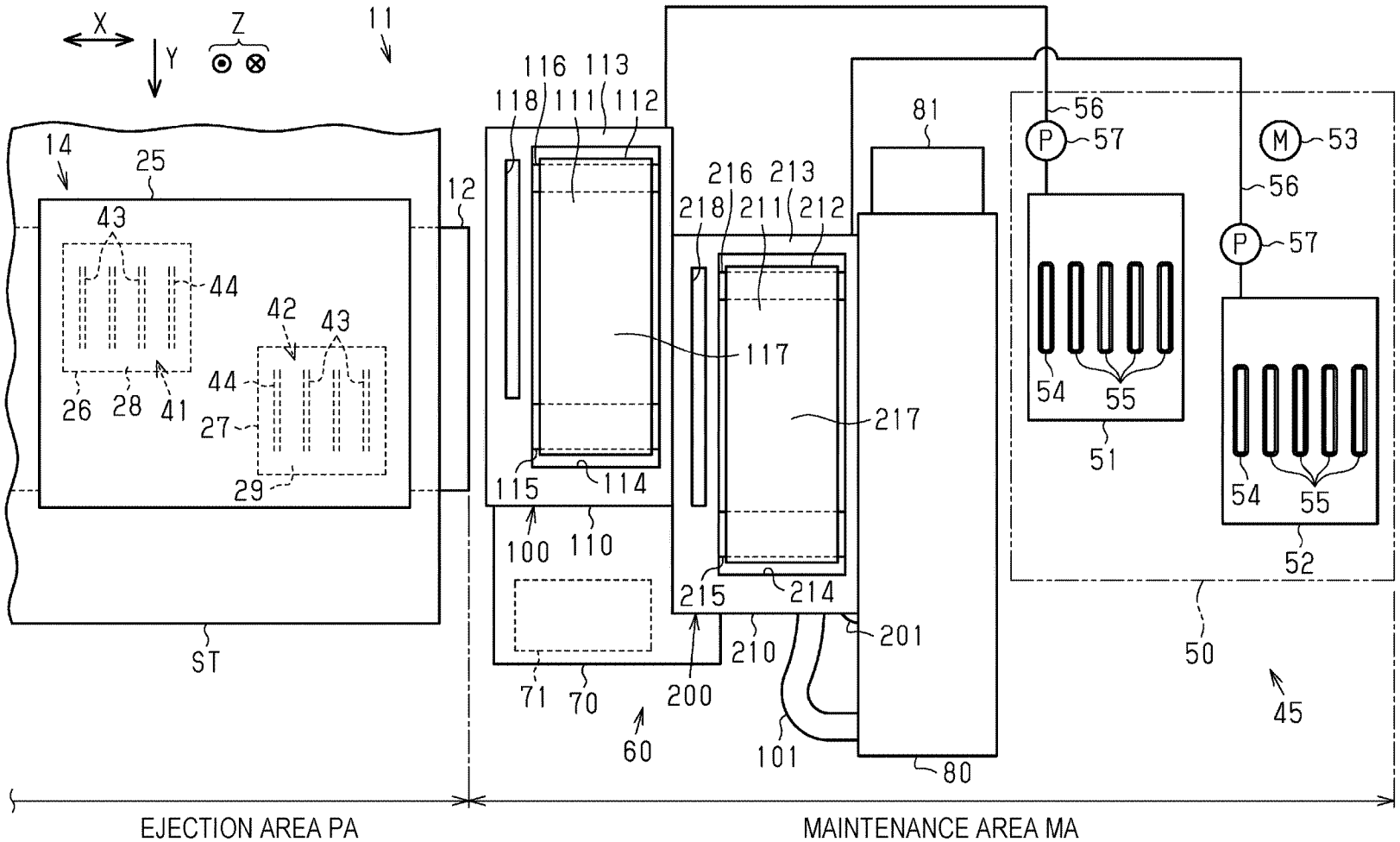
FIG. 2 is a top view schematically showing a part of the liquid ejecting apparatus.

As shown in FIG. 2, the first and the second liquid ejecting heads 26 and 27 are arranged shifted from each other so as to be partially overlapped with each other in the transport direction Y and are arranged shifted from each other so as not to be overlapped with each other in the width direction X. In other words, the first and the second liquid ejecting heads 26 and 27 are arranged shifted from each other so as to be partially overlapped with each other as seen from the width direction X and are arranged shifted from each other so as not to be overlapped with each other as seen from the transport direction Y. A first nozzle group 41 that ejects a first liquid is formed in the nozzle forming surface 28 of the first liquid ejecting head 26. A second nozzle group 42 that ejects a second liquid is formed in the nozzle forming surface 29 of the second liquid ejecting head 27. The liquid ejecting unit 14 has the first nozzle group 41 and the second nozzle group 42 in positions shifted from each other in the transport direction Y. In other words, the first nozzle group 41 is arranged so as to be shifted from the second nozzle group 42 as seen from the width direction X.

The first and the second nozzle groups 41 and 42 include a plurality of nozzle arrays 43. In the present embodiment, each of the first and the second nozzle groups 41 and 42 includes a total of eight nozzle arrays 43 where two nozzle arrays 43 located close to each other in the width direction X are arranged at regular intervals. The nozzle array 43 is composed of a large number of (for example, 180) nozzles 44 formed to be aligned at regular intervals in the transport direction Y. In other words, the nozzle array 43 is configured to extend in the transport direction Y. The first and the second liquid ejecting heads 26 and 27 eject the first and the second liquids from openings of the nozzles 44 by driving actuators not shown in the drawings.

The liquid ejecting apparatus 11 has an ejection area PA, where the liquid ejecting unit 14 can eject liquid to the medium ST supported by the support table 12, along the width direction X. In other words, the ejection area PA is an area where the liquid ejecting unit 14 can eject at least either one of the first and the second liquids to the medium ST. In the present embodiment, the ejection area PA corresponds to an area where the medium ST is supported by the support table 12 in the width direction X.

The liquid ejecting apparatus 11 has a maintenance area MA in a position adjacent to the ejection area PA in the width direction X. The maintenance area MA is provided close to one end portion in the width direction X (close to the right end portion in FIG. 2) in the liquid ejecting apparatus 11. The ejection area PA is provided in an area from a position at which the ejection area PA is adjacent to the maintenance area MA in the width direction X to the other end portion (the left end portion in FIG. 2) in the liquid ejecting apparatus 11. Therefore, it can be said that the maintenance area MA is an area located outside the ejection area PA in the width direction X with respect to the ejection area PA. The ejection area PA need not be provided up to the other end portion in the width direction X, and an area different from the ejection area PA and the maintenance area MA may be provided separately at the other end portion. In this case, the ejection area PA is provided close to the center in the width direction X in the liquid ejecting apparatus 11. Therefore, the maintenance area MA becomes an area located outside the ejection area PA.

In the maintenance area MA, a maintenance unit 45 for maintaining the liquid ejecting unit 14 is provided. The maintenance unit 45 is arranged so as to be adjacent to the support table 12 in the width direction X and is arranged so that the liquid ejecting unit 14 can face the maintenance unit 45. The maintenance unit 45 has a cap unit 50 and a flushing unit 60. In the maintenance unit 45, the flushing unit 60 and the cap unit 50 are sequentially arranged in the width direction X from the ejection area PA.

The cap unit 50 has a first cap portion 51 and a second cap portion 52 that are able to be in contact with the first liquid ejecting head 26 and the second liquid ejecting head 27, respectively. The first and the second cap portions 51 and 52 are arranged shifted in the transport direction Y so as to correspond to the arrangement of the first and the second liquid ejecting heads 26 and 27. Specifically, in the present embodiment, the first cap portion 51 is arranged closer to the ejection area PA than the second cap portion 52 in the width direction X, and is arranged more upstream than the second cap portion 52 in the transport direction Y. The cap unit 50 has a motor 53 for operating the first and the second cap portions 51 and 52. The first and the second cap portions 51 and 52 can be moved between a contact position where the first and the second cap portions 51 and 52 come into contact with the first and the second liquid ejecting heads 26 and 27 and a retreat position where the first and the second cap portions 51 and 52 are away from the first and the second liquid ejecting heads 26 and 27.

Each of the first and the second cap portions 51 and 52 has one suction cap 54 and four moisture holding caps 55. The suction cap 54 and the moisture holding caps 55 are configured to be able to perform capping of the nozzles 44. The capping is an operation to form a closed space that encloses the nozzles 44. The moisture holding cap 55 is configured to be able to perform capping of two nozzle arrays 43 located close to each other in the width direction X. That is, each of the first and the second cap portions 51 and 52 can perform capping of a total of eight nozzle arrays 43 at the same time by four moisture holding caps 55. The moisture holding cap 55 caps the nozzle arrays 43 and thereby holds moisture of liquid in the nozzles 44. A position where the moisture holding caps 55 of the first and the second cap portions 51 and 52 cap the first and the second liquid ejecting heads 26 and 27 is a home position of the liquid ejecting unit 14.

The suction cap 54 is connected with a suction pump 57 through a suction tube 56. The suction pump 57 is composed of, for example, a tube pump. When the suction pump 57 is driven in a state in which the suction cap 54 caps the nozzles 44, liquid is sucked and discharged from the nozzles 44 due to effects of negative pressure that reaches the inside of the suction cap 54. Thereby, thickened liquid, bubbles, and the like are discharged from the nozzles 44 along with the liquid, so that the nozzles 44 are cleaned. The suction cap 54 according to the present embodiment can perform cleaning for every two nozzle arrays 43 located close to each other in the width direction X.

The flushing unit 60 is configured to be able to receive liquid ejected from the liquid ejecting unit 14 by flushing. The flushing is an operation that the liquid ejecting unit 14 ejects liquid that is not used for printing in order to prevent occurrence of clogging and the like of the nozzles 44. The liquid ejecting apparatus 11 according to the present embodiment inspects an ejection state of liquid ejected from the nozzles 44 when performing the flushing. In the present embodiment, the liquid ejecting apparatus 11 performs the inspection based on a residual vibration of a vibration plate in a pressure chamber due to driving of actuators included in the first and the second liquid ejecting heads 26 and 27.

A means and a method of detecting a discharge (ejection) abnormality of the nozzles 44 in the liquid ejecting apparatus 11 are not limited to the method as described above which detects and analyzes a vibration pattern of the residual vibration of the vibration plate as described above. As modified examples of the discharge abnormality detection method, there are the following methods. For example, there is a method in which a laser light such as an optical sensor is directly emitted and reflected by an ink meniscus in a nozzle, a vibration state of the meniscus is detected by a light receiving element, and a cause of clogging is identified from the vibration state. Alternatively, the presence or absence of discharge abnormality is detected by using a general optical dot omission detector that detects whether or not a flying droplet enters a detection range of a sensor. Then, it is estimated that a discharge abnormality, which occurs after a predetermined drying time in which dot omission may occur elapses since the discharge operation, is caused by drying, and it is estimated that a discharge abnormality, which occurs before the drying time elapses, is caused by adhesion of foreign substances or mixing of bubbles. This is another discharge abnormality detection method. Further, there is a method in which a vibration sensor is added to the optical dot omission detector described above, it is determined whether or not a vibration, where bubbles can be mixed before a discharge abnormality occurs, has been added, and it is determined that the mixing of bubbles is a cause of the discharge abnormality when such a vibration has been added. Further, the dot omission detection means need not be limited to optical methods, and, for example, it is possible to use a heat sensing type detector that detects temperature change in a heat sensing portion when receiving a discharge of droplet, a detector that electrically charges an ink droplet, discharges the ink droplet, and detects a change in the amount of charge in a detection electrode where the ink droplet lands, an electrostatic capacitance type detector that detects an electrostatic capacitance which changes when an ink droplet passes through between electrodes, or a method which detects an inspection pattern, which is formed by ejecting liquid from the liquid ejecting head to the medium ST and a receiving surface of the flushing unit 60, as image information by a camera or the like. In addition, as methods of detecting adhesion of paper powder, a method of detecting a state of a nozzle surface as image information by a camera or the like and a method of detecting the presence or absence of adhesion of paper powder by scanning a portion near the nozzle surface by an optical sensor such as a laser are considered.

The flushing unit 60 has a first receiving portion 100, a second receiving portion 200, a base mount 70 that supports the first receiving portion 100 and the second receiving portion 200, and a collection box 80. The first receiving portion 100 is configured to be able to receive the first liquid ejected from the first liquid ejecting head 26 by flushing. The second receiving portion 200 is configured to be able to receive the second liquid ejected from the second liquid ejecting head 27 by flushing. The first receiving portion 100 and the second receiving portion 200 are arranged in positions shifted from each other in the transport direction Y so as to correspond to an arrangement of the first nozzle group 41 of the first liquid ejecting head 26 and the second nozzle group 42 of the second liquid ejecting head 27. In the present embodiment, the first receiving portion 100 is arranged closer to the ejection area PA than the second receiving portion 200 in the width direction X and is arranged more upstream than the second receiving portion 200 in the transport direction Y. The first and the second receiving portions 100 and 200 are connected to a common collection box 80 through tubes 101 and 201, respectively.

The first receiving portion 100 has a first rotating body 112, which is a first reception portion having a circumferential surface 111 that can receive the first liquid, and a first rotating body holder 110, which is a first reception portion holder where the first rotating body 112 is held. The second receiving portion 200 has a second rotating body 212, which is a second reception portion having a circumferential surface 211 that can receive the second liquid, and a second rotating body holder 210, which is a second reception portion holder where the second rotating body 212 is held.

Specifically, the first rotating body 112 is arranged closer to the ejection area PA than the second rotating body 212 in the width direction X. In the present embodiment, the first rotating body 112 and the second rotating body 212 are formed of a belt-like member such as, for example, a belt. The first rotating body 112 and the second rotating body 212 have widths greater than or equal to those of the first nozzle group 41 and the second nozzle group 42, respectively. The first and the second receiving portions 100 and 200 are connected with the suction tubes 56 and 56 extending from the moisture holding caps 55 and 55 of the first and the second cap portions 51 and 52, respectively.

Upper surfaces 113 and 213 of the first and the second rotating body holders 110 and 210 have exposure openings 114 and 214 from which the insides of the first and the second rotating body holders 110 and 210 are exposed. The first and the second rotating body holders 110 and 210 are rotatably attached with driving rollers 115 and 215 and driven rollers 116 and 216. The driving rollers 115 and 215 and the driven rollers 116 and 216 are arranged in the first and the second rotating body holders 110 and 210 so that parts of the driving rollers 115 and 215 and the driven rollers 116 and 216 are exposed from the exposure openings 114 and 214 when seen from above. The driving rollers 115 and 215 and the driven rollers 116 and 216 are arranged with a predetermined distance in between in the transport direction Y. The driving rollers 115 and 215 are located on the downstream side of the driven rollers 116 and 216 in the transport direction Y and formed of rollers whose diameters are greater than those of the driven rollers 116 and 216.

The first and the second rotating bodies 112 and 212 are laid over a plurality of rollers including the driving rollers 115 and 215 and the driven rollers 116 and 216 and are held by the first and the second rotating body holders 110 and 210. At this time, parts of the circumferential surfaces 111 and 211 of the first and the second rotating bodies 112 and 212 are exposed through the exposure openings 114 and 214. Specifically, on the circumferential surfaces 111 and 211 of the first and the second rotating bodies 112 and 212, parts that are exposed from the exposure openings 114 and 214 are receiving surfaces 117 and 217 for receiving the first and the second liquids. In the present embodiment, the receiving surfaces 117 and 217 extend to be horizontal surfaces. The first and the second rotating bodies 112 and 212 are arranged so that the receiving surfaces 117 and 217 form parts of the upper surfaces 113 and 213 of the first and the second rotating body holders 110 and 210.

A driving source 71 for driving the driving rollers 115 and 215 of the first and the second receiving portions 100 and 200 is attached to the base mount 70. The driving source 71 drives and rotates the driving rollers 115 and 215 of the first and the second receiving portions 100 and 200 by its driving force. The driven rollers 116 and 216 are driven and rotated with respect to the driving rotation of the driving rollers 115 and 215 through the first and the second rotating bodies 112 and 212. Specifically, by a rotation of a plurality of rollers including the driving rollers 115 and 215 and the driven rollers 116 and 216, the first and the second rotating bodies 112 and 212 rotate so that their circumferential surfaces 111 and 211 move around the rollers. At this time, the first and the second rotating bodies 112 and 212 of the present embodiment rotate around the rollers so that the receiving surfaces 117 and 217 that receive the liquids move toward the upstream side in the transport direction Y. In other words, in the transport direction Y, the first rotating body 112 rotates in a direction being away from the second rotating body 212.

The first rotating body holder 110 has a slit-shaped first suction opening 118 extending in the transport direction Y. The first suction opening 118 is arranged closer to the ejection area PA than the position where the first rotating body 112 is provided in the first rotating body holder 110. In other words, the first suction opening 118 is arranged at a position between the ejection area PA and the first rotating body 112 in the width direction X.

The second rotating body holder 210 has a slit-shaped second suction opening 218 extending in the transport direction Y. The second suction opening 218 is arranged closer to the ejection area PA than the position where the second rotating body 212 is provided in the second rotating body holder 110. In other words, the second suction opening 218 is arranged at a position between the first rotating body 112 and the second rotating body 212 in the width direction X.

The collection box 80 has a suction fan 81 for sucking the inside of the collection box 80 on its end portion on the upstream side in the transport direction Y. Specifically, the suction fan 81 is driven so as to exhaust gas from the inside of the collection box 80 to the outside of the collection box 80. The tubes 101 and 201 communicate the inside of the collection box 80 with the first and the second suction openings 118 and 218 of the first and the second rotating body holders 110 and 210. Specifically, when the suction fan 81 is driven, the first and the second suction openings 118 and 218 suck atmospheres in spaces facing the first and the second rotating body holders 110 and 210 through the tubes 101 and 201 and the collection box 80. In other words, the first and the second suction openings 118 and 218 can suck an atmosphere facing the liquid ejecting unit 14 located above the first and the second suction openings 118 and 218 in the vertical direction Z.

When the liquid ejecting unit 14 performs flushing, the first and the second liquids are ejected to the first and the second rotating bodies 112 and 212, so that mist, which is foggy splash of the first and the second liquids, may occur. The first and the second suction openings 118 and 218 are openings for sucking the mist of the first and the second liquids. The first suction opening 118 mainly sucks the mist of the first liquid. The second suction opening 218 mainly sucks the mist of the second liquid. The mist of the first and the second liquids also occurs when the medium ST is printed in the ejection area PA. The collection box 80 collects the mist of the first and the second liquids, which is sucked from the first and the second suction openings 118 and 218.

Figure 3:
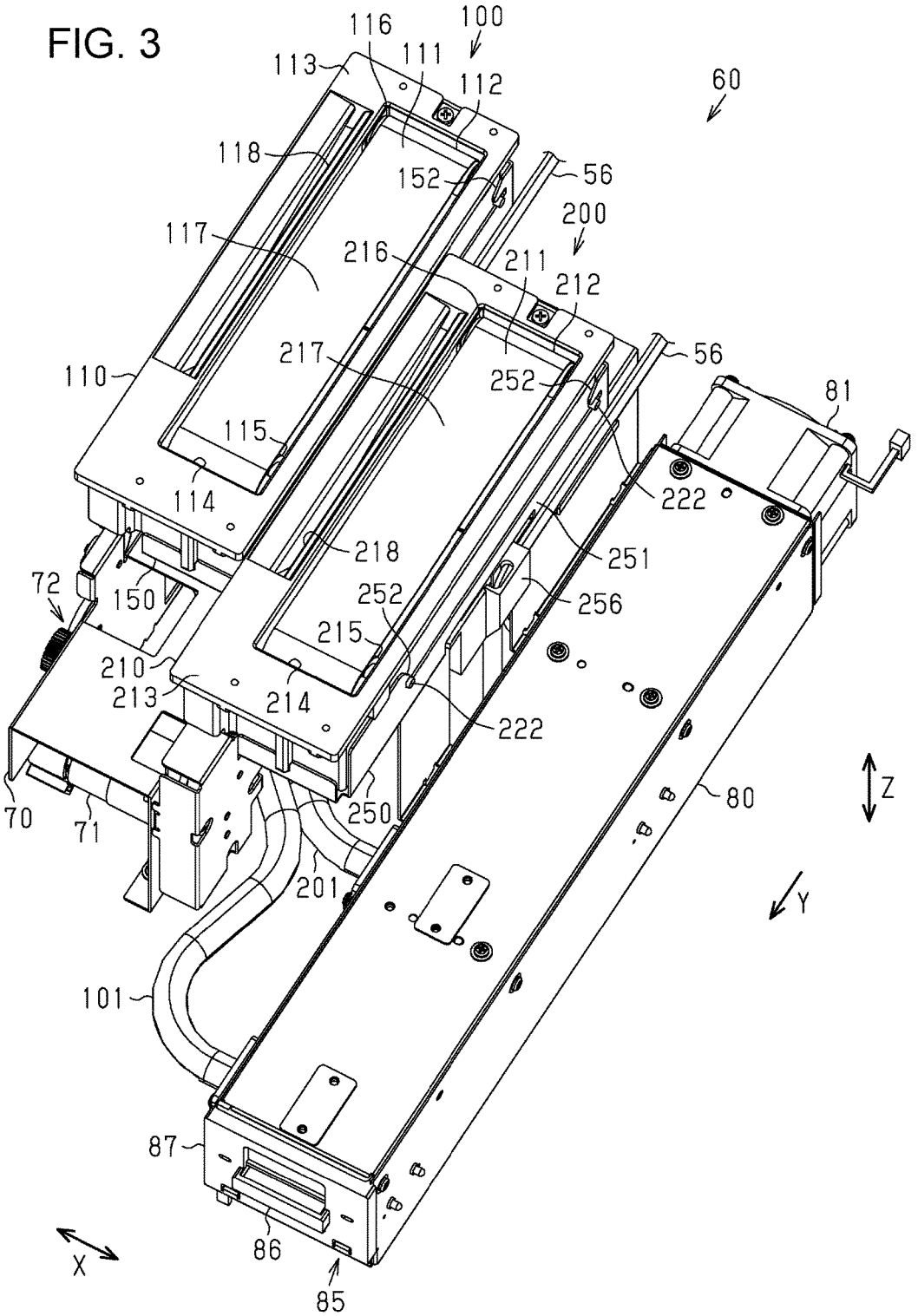
FIG. 3 is a perspective view of a flushing unit.
Figure 4:
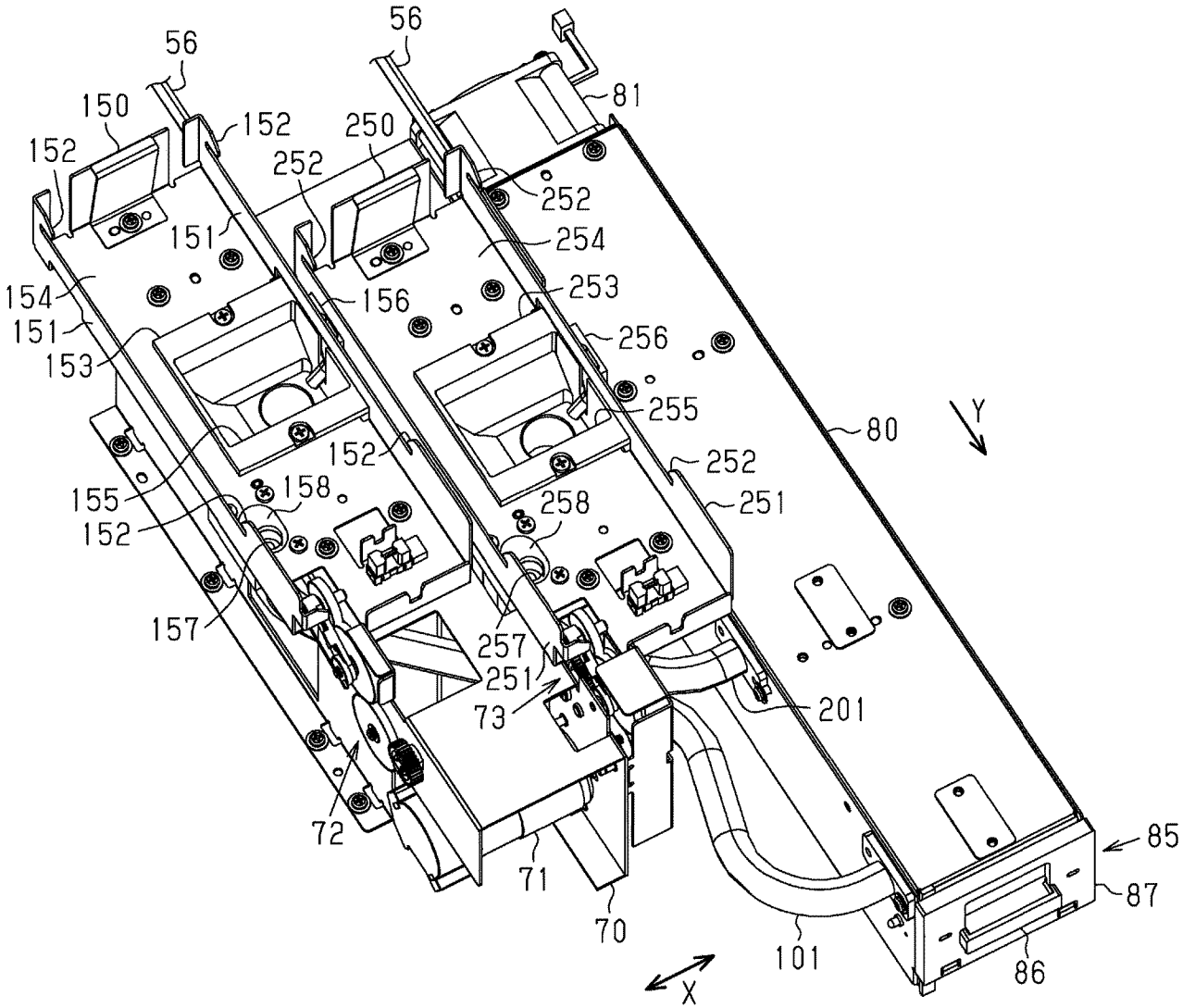
FIG. 4 is a perspective view of a first attaching unit and a second attaching unit.

Next, a specific configuration of the first receiving portion 100 and the second receiving portion 200 will be described. As shown in FIGS. 3 and 4, the first and the second receiving portions 100 and 200 are integrally attached to the base mount 70. The base mount 70 is arranged at a position immediately below the first receiving portion 100. The base mount 70 has transmission mechanisms 72 and 73 for transmitting a driving force of the driving source 71, in addition to the driving source 71. The transmission mechanisms 72 and 73 are formed of a plurality of members such as gears, a belt, and pulleys. The transmission mechanisms 72 and 73 are separately provided at positions on both sides of the base mount 70 in the width direction X. The transmission mechanism 72 located close to the ejection area PA in the width direction X transmits the driving force of the driving source 71 to the driving roller 115 of the first rotating body holder 110. The transmission mechanism 73 located close to the second receiving portion 200 opposite to the ejection area PA in the width direction X transmits the driving force of the driving source 71 to the driving roller 215 of the second rotating body holder 210. The transmission mechanisms 72 and 73 are driven in synchronization with each other. Therefore, the first and the second rotating bodies 112 and 212 are rotated in synchronization with each other when the driving source 71 is driven.

The first receiving portion 100 includes a first attaching unit 150 to which the first rotating body holder 110 is detachably attached. The second receiving portion 200 includes a second attaching unit 250 to which the second rotating body holder 210 is detachably attached. The first and the second attaching units 150 and 250 are provided as frame bodies whose upper portions are open. The first and the second attaching units 150 and 250 have claws 152 and 252, to which the first and the second rotating body holders 110 and 210 are attached, on side walls 151 and 251 in the width direction X, respectively. The claws 152 and 252 are provided at positions on the upstream side and the downstream side in the transport direction Y on the side walls 151 and 251 in the first and the second attaching units 150 and 250, respectively. Specifically, in the present embodiment, each of the first and the second attaching units 150 and 250 has a total of four claws 152, 252.

The first attaching unit 150 includes a first collection unit 153 that collects the first liquid ejected to the first rotating body 112. That is, the first attaching unit 150 is configured by including the first collection unit 153. The second attaching unit 250 includes a second collection unit 253 that collects the second liquid ejected to the second rotating body 212. That is, the second attaching unit 250 is configured by including the second collection unit 253. The first and the second collection units 153 and 253 are formed as containers that can collect the first and the second liquids. The first and the second collection units 153 and 253 are arranged so as to be buried into bottom walls 154 and 254 of the first and the second attaching units 150 and 250. The first and the second collection units 153 and 253 are attached to the bottom walls 154 and 254 so that collection openings 155 and 255 that open upward are along the bottom walls 154 and 254 of the first and the second attaching units 150 and 250. The first and the second collection units 153 and 253 have a shape recessed downward from the bottom walls 154 and 254 of the first and the second attaching units 150 and 250, and edge portions of the collection openings 155 and 255 are fixed to the bottom walls 154 and 254 of the first and the second attaching units 150 and 250.

The first collection unit 153 has a connection portion 156 to which the suction tube 56 extending from the suction cap 54 of the first cap portion 51 is connected. The suction tube 56 extends along the side wall 151 of the first attaching unit 150, which faces the second receiving portion 200 in the width direction X. The second collection unit 253 has a connection portion 256 to which the suction tube 56 extending from the suction cap 54 of the second cap portion 52 is connected. The suction tube 56 extends along the side wall 251 of the second attaching unit 250, which faces the collection box 80 in the width direction X. The suction tubes 56 and 56 pass along the side walls 151 and 251 of the first and the second attaching units 150 and 250 and pass through the connection portions 156 and 256 of the first and the second collection units 153 and 253, and the tips of the suction tubes 56 and 56 are introduced into the collection openings 155 and 255 of the first and the second collection units 153 and 253. As a result, the first and the second liquids sucked by the suction pumps 57 and 57 of the first and the second cap portions 51 and 52 are collected by the first and the second collection units 153 and 253 through the suction tubes 56 and 56, respectively.

The first and the second attaching units 150 and 250 have connection ports 157 and 257 to which the tubes 101 and 201 extending from the collection box 80 are connected. The connection ports 157 and 257 have openings in the bottom walls 154 and 254 of the first and the second attaching units 150 and 250. The tubes 101 and 201 are connected to the connection ports 157 and 257 from below the connection ports 157 and 257, that is, from the side where the base mount 70 is located. The first and the second attaching units 150 and 250 have seal members 158 and 258 which are buried so as to surround the connection ports 157 and 257, in the bottom walls 154 and 254. The seal members 158 and 258 are formed of an elastic body such as, for example, a rubber.

Figure 5:
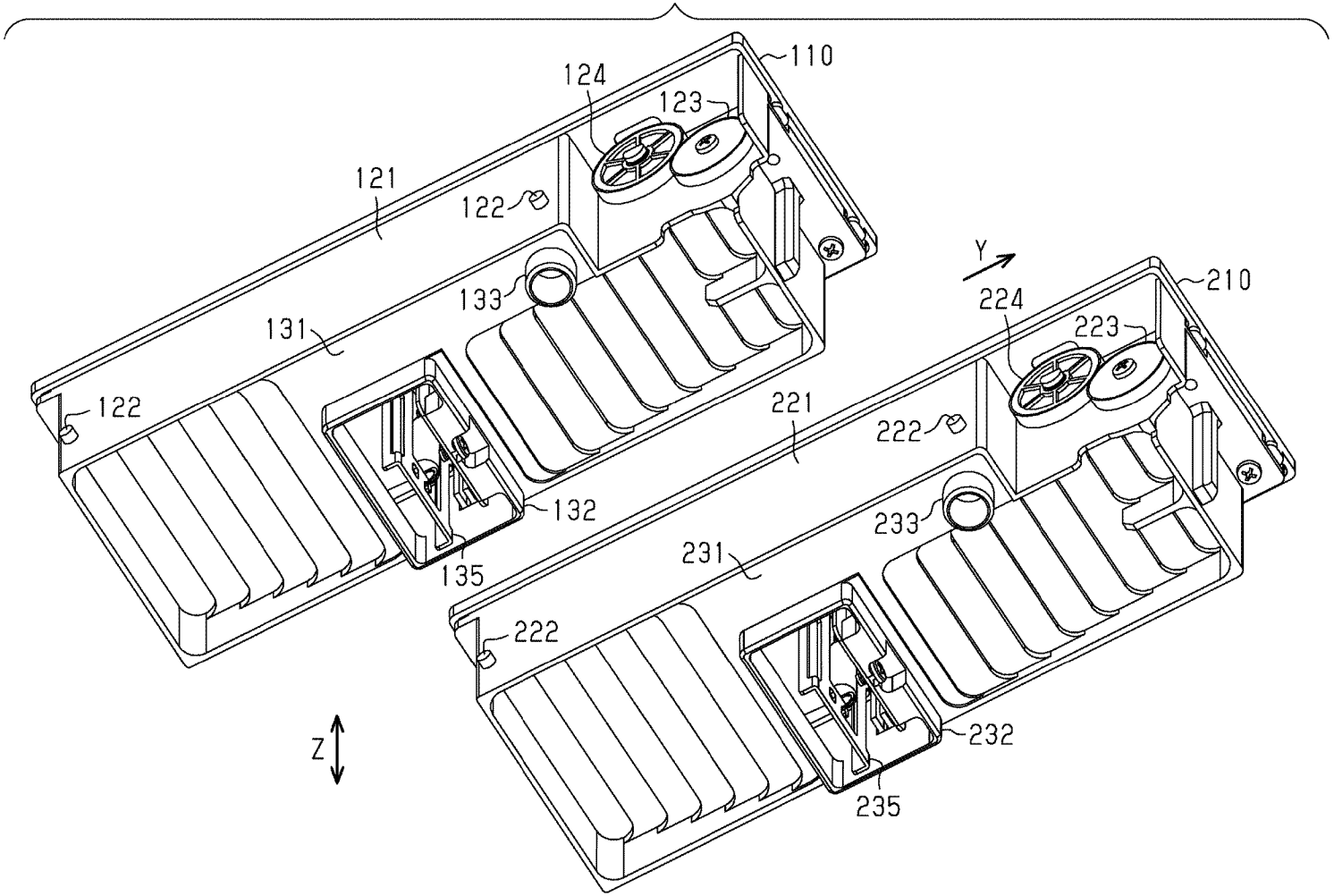
FIG. 5 is a perspective view of a first rotating body holder and a second rotating body holder.
Figure 6:
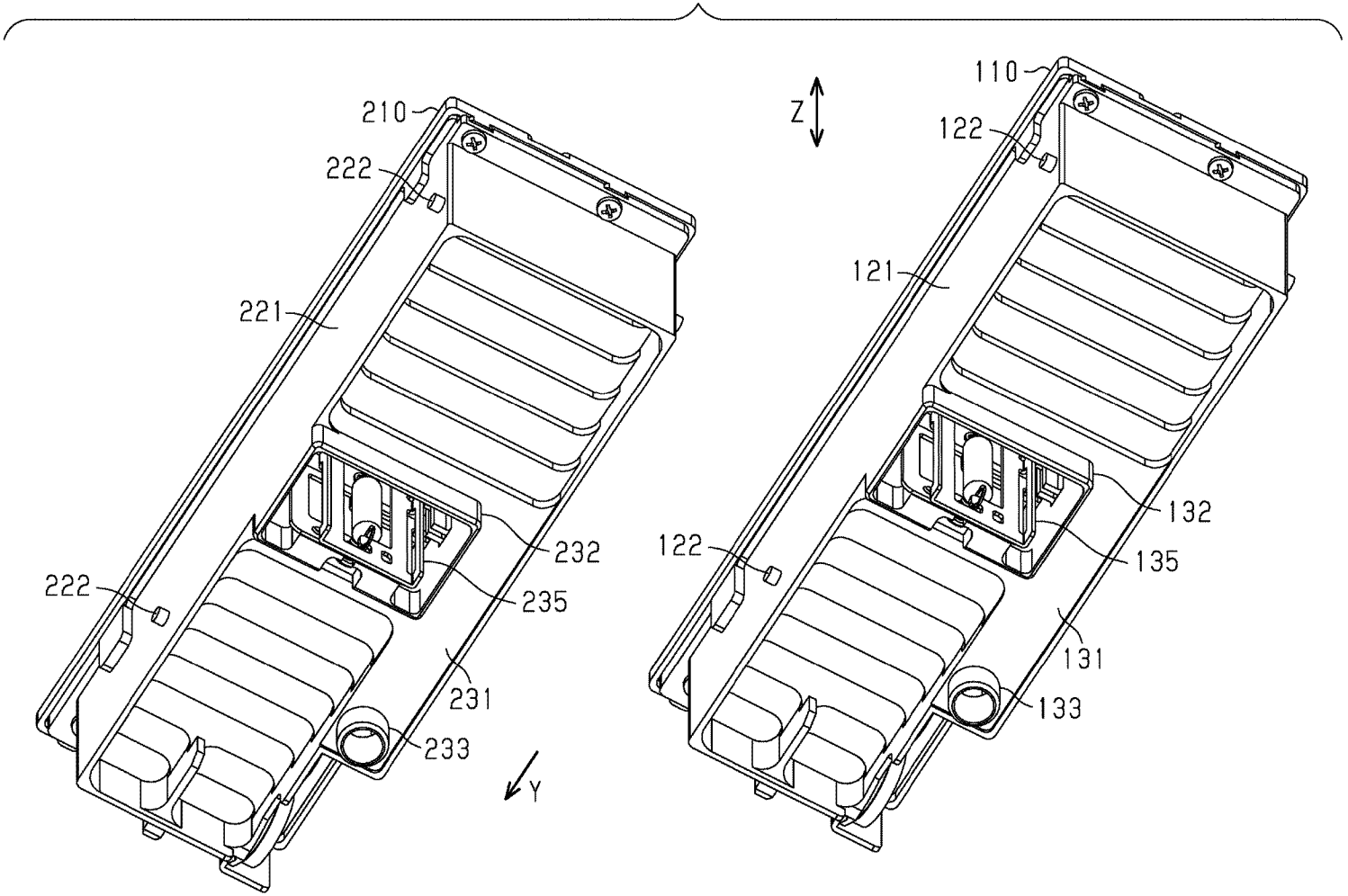
FIG. 6 is a perspective view of the first rotating body holder and the second rotating body holder.

Next, the first rotating body holder 110 and the second rotating body holder 210 will be described. As shown in FIGS. 5 and 6, the first and the second rotating body holders 110 and 210 are provided so as to have a box-like shape. Side surfaces 121 and 221 extending in the transport direction Y on both sides of the first and the second rotating body holders 110 and 210 are provided with bosses 122 and 222 which can be engaged with the claws 152 and 252 of the first and the second attaching units 150 and 250. The bosses 122 and 222 protrude cylindrically from the side surfaces 121 and 221, and a total of four bosses 122 and 222 are provided so as to correspond to the claws 152 and 252 of the first and the second attaching units 150 and 250.

The first and the second rotating body holders 110 and 210 have downstream side gears 123 and 223 and upstream side gears 124 and 224 which are arranged to be engaged with each other on the side surfaces 121 and 221 close to the ejection area PA in the width direction X. On the side surfaces 121 and 221, the downstream side gears 123 and 223 and the upstream side gears 124 and 224 are attached at positions near the downstream end in the transport direction Y, which corresponds to the longitudinal direction of the side surfaces 121 and 221. The downstream side gears 123 and 223 are gears which are engaged with the transmission mechanisms 72 and 73 when the first and the second rotating body holders 110 and 210 are attached to the first and the second attaching units 150 and 250. The upstream side gears 124 and 224 are configured to be able to rotate in synchronization with the driving rollers 115 and 215. Specifically, the downstream side gears 123 and 223 and the upstream side gears 124 and 224 transmit the driving force of the driving source 71 transmitted from the transmission mechanisms 72 and 73 to the driving rollers 115 and 215 when the first and the second rotating body holders 110 and 210 are attached to the first and the second attaching units 150 and 250.

Rectangular discharge openings 132 and 232 open in lower surfaces 131 and 231 of the first and the second rotating body holders 110 and 210. The discharge openings 132 and 232 cylindrically protrude downward from the lower surfaces 131 and 231 and are provided near the center of the lower surfaces 131 and 231 in the transport direction Y. The discharge openings 132 and 232 communicate with the exposure openings 114 and 214 through inside the first and the second rotating body holders 110 and 210. When the first and the second rotating body holders 110 and 210 are attached to the first and the second attaching units 150 and 250, the discharge openings 132 and 232 are positioned so as to face the collection openings 155 and 255 of the first and the second collection units 153 and 253.

Circular air intake openings 133 and 233 open in the lower surfaces 131 and 231 of the first and the second rotating body holders 110 and 210. The air intake openings 133 and 233 cylindrically protrude downward from the lower surfaces 131 and 231 and are provided at positions near the downstream end of the lower surfaces 131 and 231 in the transport direction Y. The air intake openings 133 and 233 communicate with the first and the second suction openings 118 and 218 through inside the first and the second rotating body holders 110 and 210. When the first and the second rotating body holders 110 and 210 are attached to the first and the second attaching units 150 and 250, the tips of the air intake openings 133 and 233 come into contact with the seal members 158 and 258 provided on the bottom walls 154 and 254 of the first and the second attaching units 150 and 250. In other words, when the first and the second rotating body holders 110 and 210 are attached to the first and the second attaching units 150 and 250, the air intake openings 133 and 233 communicate with the connection ports 157 and 257 of the first and the second attaching units 150 and 250 in a sealed state.

Figure 7:
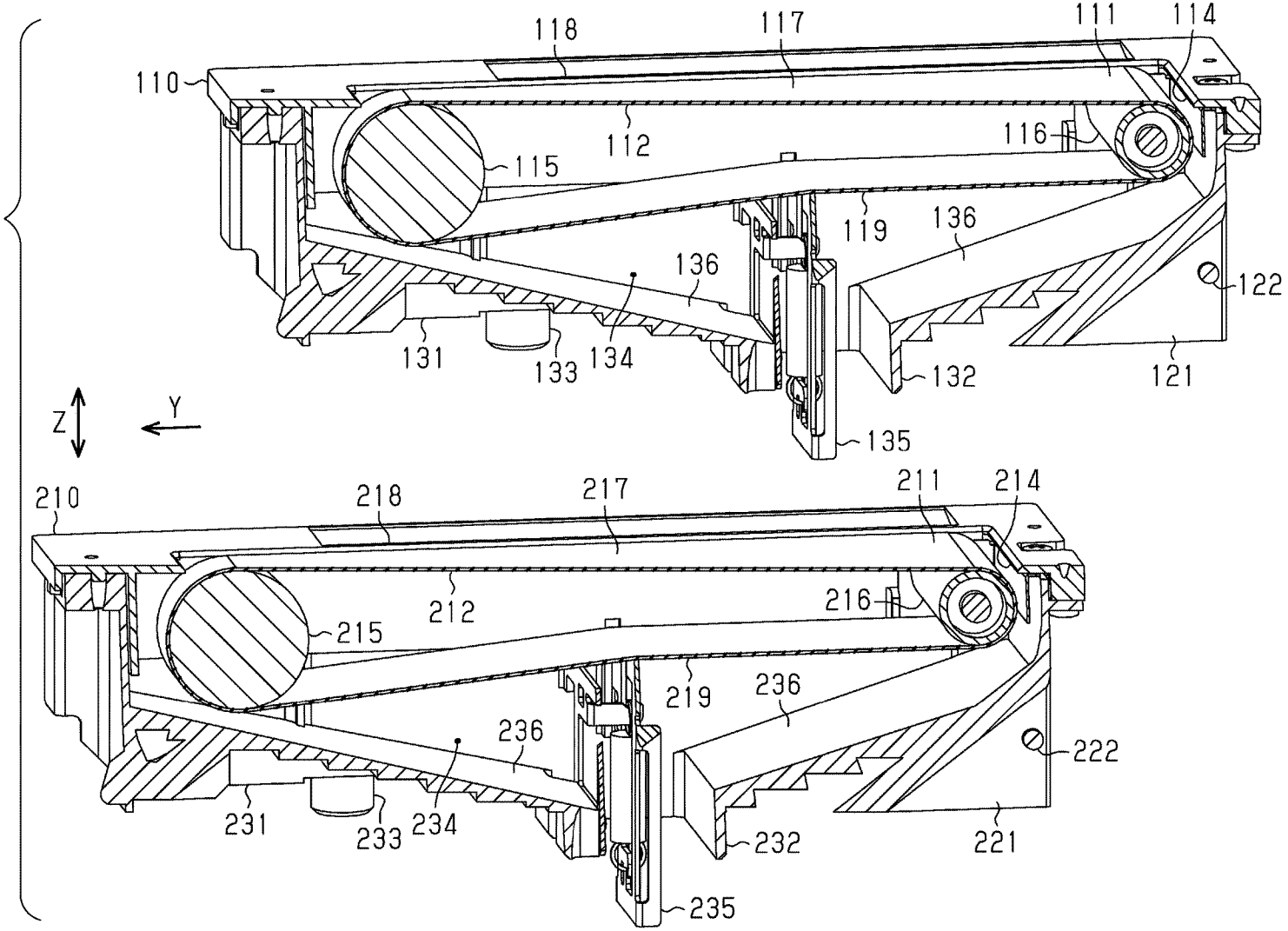
FIG. 7 is a perspective cross-sectional view of the first rotating body holder and the second rotating body holder.

As shown in FIG. 7, the first and the second rotating body holders 110 and 210 have storage chambers 134 and 234 where the exposure openings 114 and 214 and the discharge openings 132 and 232 open. The first rotating body holder 110 stores the driving roller 115, the driven roller 116, the first rotating body 112, and a first sliding contact member 135 in the storage chamber 134. The second rotating body holder 210 stores the driving roller 215, the driven roller 216, the second rotating body 212, and a second sliding contact member 235 in the storage chamber 234. The first and the second sliding contact members 135 and 235 are formed of a plate-like member such as, for example, a scraper. The first and the second sliding contact members 135 and 235 are held by the first and the second rotating body holders 110 and 210 so that the first and the second sliding contact members 135 and 235 extend in the vertical direction Z and lower portions thereof partially protrude from the discharge openings 132 and 232. When the first and the second rotating body holders 110 and 210 are attached to the first and the second attaching units 150 and 250, the first and the second sliding contact members 135 and 235 are positioned so that lower portions thereof partially enter into the collection openings 155 and 255 of the first and the second collection units 153 and 253.

Upper tip portions of the first and the second sliding contact members 135 and 235 are in contact with the circumferential surfaces 111 and 211 of the first and the second rotating bodies 112 and 212. In the present embodiment, the upper tip portions are in contact with the circumferential surfaces 111 and 211 so as to apply some tension to the first and the second rotating bodies 112 and 212, which are laid over the driving rollers 115 and 215 and the driven rollers 116 and 216. The first and the second sliding contact members 135 and 235 are in contact with scraping surfaces 119 and 219 opposite to the receiving surfaces 117 and 217, which are exposed from the exposure openings 114 and 214, of the circumferential surfaces 111 and 211 of the first and the second rotating bodies 112 and 212 in the vertical direction Z. The scraping surfaces 119 and 219 extend obliquely as compared with the receiving surfaces 117 and 217 which are horizontal surfaces. When the first and the second rotating bodies 112 and 212 rotate, the first and the second sliding contact members 135 and 235 are slidably in contact with the circumferential surfaces 111 and 211 of the first and the second rotating bodies 112 and 212.

The first and the second sliding contact members 135 and 235 are slidably in contact with the circumferential surfaces 111 and 211 of the first and the second rotating bodies 112 and 212, so that when the first and the second rotating bodies 112 and 212 rotate in a state in which the first and the second liquids are attached to the circumferential surfaces 111 and 211 by flushing, the first and the second sliding contact members 135 and 235 scrape the first and the second liquids attached to the circumferential surfaces 111 and 211. The first and the second liquids scraped by the first and the second sliding contact members 135 and 235 flow down from the discharge openings 132 and 232 along the first and the second sliding contact members 135 and 235, respectively, and are collected by the first and the second collection units 153 and 253 of the first and the second attaching units 150 and 250. At this time, the circumferential surfaces 111 and 211 of the first and the second rotating bodies 112 and 212, from which the first and the second liquids are scraped, are updated from a state in which the first and the second liquids are attached to a state in which the first and the second liquids are not attached.

Bottom surfaces 136 and 236 in the storage chambers 134 and 234 are inclined so as to form a funnel shape toward the discharge openings 132 and 232 in the transport direction Y. In other words, in the storage chambers 134 and 234, liquids dropping from the circumferential surfaces 111 and 211 of the first and the second rotating bodies 112 and 212 flow along the bottom surfaces 136 and 236 of the storage chambers 134 and 234, flow down from the discharge openings 132 and 232, and are collected in the first and the second collection units 153 and 253. Moisture in the storage chambers 134 and 234 is maintained by the first and the second liquids collected in the first and the second collection units 153 and 253.

Figure 8:
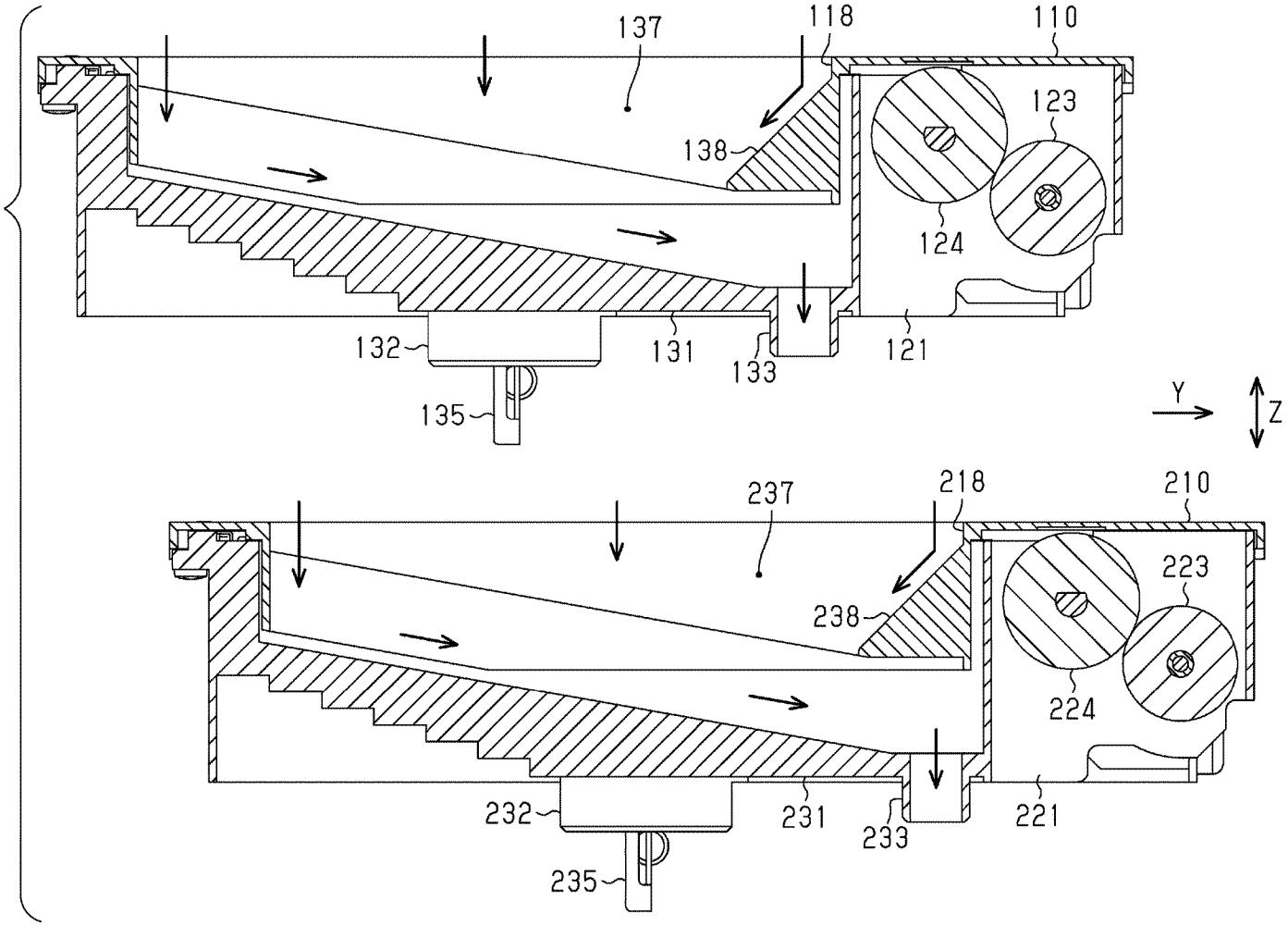
FIG. 8 is a side cross-sectional view of the first rotating body holder and the second rotating body holder.

As shown in FIG. 8, the first and the second rotating body holders 110 and 210 have suction chambers 137 and 237 where the first and the second suction openings 118 and 218 and the air intake openings 133 and 233 open. The suction chambers 137 and 237 are spaces separated from the storage chambers 134 and 234. The first and the second rotating body holders 110 and 210 have shield members 138 and 238 in the suction chambers 137 and 237. The shield members 138 and 238 are arranged immediately above the air intake openings 133 and 233. As shown by arrows in FIG. 8, the shield members 138 and 238 shield gas so as not to directly suck gas from a position near the downstream side in the transport direction Y of the first and the second suction openings 118 and 218. When the shield members 138 and 238 are not provided, in the first and the second suction openings 118 and 218, a suction force increases in a relatively downstream portion near the air intake openings 133 and 233 in the transport direction Y. As a result, the suction force varies in the first and the second suction openings 118 and 218. Therefore, the liquid ejecting apparatus 11 according to the present embodiment equalizes the suction force in the first and the second suction openings 118 and 218 by providing the shield members 138 and 238 in the suction chambers 137 and 237.

Figure 9:
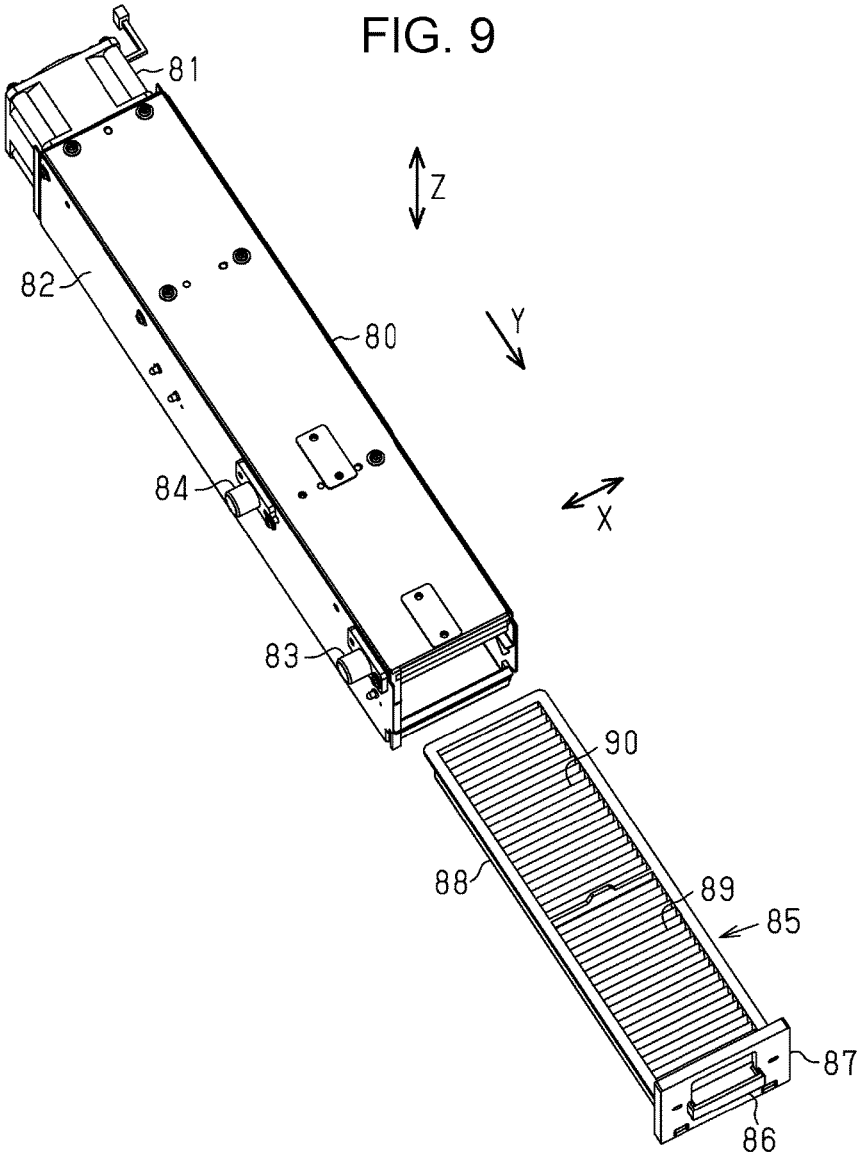
FIG. 9 is a perspective view of a collection box.
Figure 10:
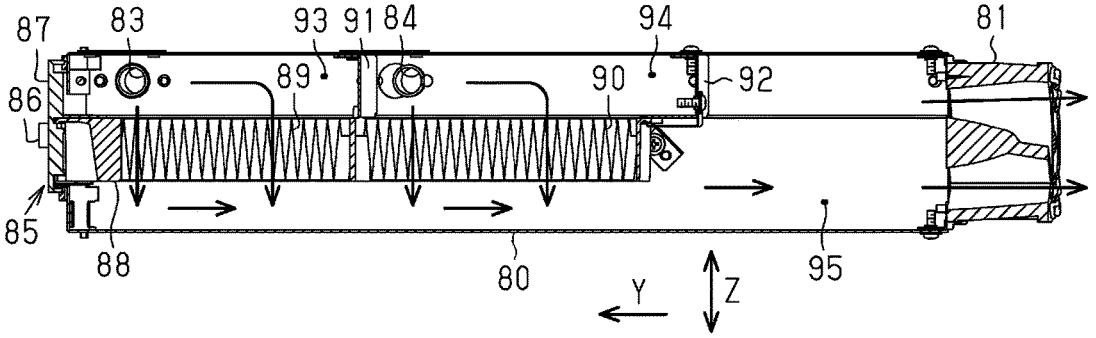
FIG. 10 is a perspective cross-sectional view of the collection box.

Next, the collection box 80 will be described. As shown in FIGS. 9 and 10, the collection box 80 has a cylindrical first connection pipe 83 and a cylindrical second connection pipe 84, to which the tubes 101 and 201 are connected, in a side surface 82 which extends in the transport direction Y corresponding to the longitudinal direction of the collection box 80 and which is a surface closer to the ejection area PA in the width direction X. The first and the second connection pipes 83 and 84 communicate the inside of the collection box 80 with the outside of the collection box 80. The collection box 80 has a filter cassette 85 that can be detachably attached to the collection box 80. The filter cassette 85 can be inserted into and removed from the collection box 80 from the downstream side in the transport direction Y. The filter cassette 85 has a front plate 87 having a handle 86, a frame body 88 extending from the front plate 87, and a first filter material 89 and a second filter material 90 which are attached to the frame body 88. The first and the second filter materials 89 and 90 are provided in a bellows shape and formed of the same material. The frame body 88 holds the first filter material 89 and the second filter material 90 in this order from the downstream side to the upstream side in the transport direction Y.

The inside of the collection box 80 is partitioned into a plurality of spaces by a plurality of partition plates 91 and 92. In the collection box 80, a first partition chamber 93 where the first connection pipe 83 opens, a second partition chamber 94 where the second connection pipe 84 opens, and a common chamber 95 communicating with the first partition chamber 93 and the second partition chamber 94 are provided. The common chamber 95 communicates with the suction fan 81. When the filter cassette 85 is attached to the collection box 80, the common chamber 95 is partitioned from the first partition chamber 93 through the first filter material 89 and is partitioned from the second partition chamber 94 through the second filter material 90. Therefore, the mist of the first and the second liquids, which is sucked from the first and the second suction openings 118 and 218 by the suction fan 81 and guided to the first and the second partition chambers 93 and 94, is captured by the first and the second filter materials 89 and 90 as shown by arrows in FIG. 10. Gas sucked from the first and the second suction openings 118 and 218 along with the mist is exhausted from the common chamber 95 to the outside of the collection box 80 through the suction fan 81 as shown by arrows in FIG. 10.

Next, an operation of the liquid ejecting apparatus 11 configured as described above will be described. When the liquid ejecting unit 14 can eject the first and the second liquids whose characteristics are different from each other, the first and the second liquids may chemically react with each other depending on types of the liquids. For example, in the present embodiment, the first liquid is a treatment liquid that facilitates fixing of the second liquid, so that when the first liquid and the second liquid react with each other, the fixing of the second liquid is facilitated by action of the first liquid. In this case, when both the first liquid and the second liquid are attached to a circumferential surface of a rotating body that receives liquid ejected by flushing, the second liquid is fixed to the circumferential surface of the rotating body. When the liquid is fixed to the circumferential surface of the rotating body, an operation failure occurs in a rotation operation of the rotating body due to accumulation of liquid on the circumferential surface, so that it is difficult to properly perform flushing. Therefore, the present embodiment includes a collection unit for each type of liquid ejected by the liquid ejecting unit 14. Therefore, when the liquid ejecting unit 14 performs flushing, the first liquid is ejected to the first rotating body 112 and the second liquid is ejected to the second rotating body 212, so that a risk is reduced where the first and the second liquids are mixed on the circumferential surfaces 111 and 211 of the first and the second rotating bodies 112 and 212.

When the liquid ejecting unit 14 performs flushing, the first and the second liquids are attached to the circumferential surfaces 111 and 211 of the first and the second rotating bodies 112 and 212 in a state in which the rotations of the first and the second rotating bodies 112 and 212 are stopped. The first and the second rotating bodies 112 and 212 rotate after the flushing of the liquid ejecting unit 14 is completed, the first and the second liquids are scraped from the circumferential surfaces 111 and 211 by the first and the second sliding contact members 135 and 235, and the first and the second liquids are collected into the first and the second collection units 153 and 253.

According to the embodiment described above, it is possible to obtain the following effects:

(1) The first liquid collected from the first rotating body 112 by the first sliding contact member 135 is collected by the first collection unit 153, and the second liquid collected from the second rotating body 212 by the second sliding contact member 235 is collected by the second collection unit 253. Therefore, a risk is reduced where the collected first liquid and second liquid are mixed. Thus, it is possible to properly perform flushing even when ejecting a plurality of liquids whose characteristics are different from each other.

(2) The first collection unit 153 and the second collection unit 253 are separately provided in the first attaching unit 150 and the second attaching unit 250, respectively. Therefore, it is possible to reduce a risk that the first liquid and the second liquid, which are collected into the first collection unit 153 and the second collection unit 253, are mixed.

(3) The first rotating body 112 and the second rotating body 212 are belt-like members, so that it is possible to secure large areas of the circumferential surfaces 111 and 211 (the receiving surfaces 117 and 217) of the first rotating body 112 and the second rotating body 212, which can receive the first liquid and the second liquid.

(4) The second suction opening 218 is arranged at a position between the first rotating body 112 and the second rotating body 212 in the width direction X. Therefore, the mist of the first liquid and the second liquid ejected from the liquid ejecting unit 14 can be sucked from the second suction opening 218. As a result, when the liquid ejecting unit 14 performs flushing, it is possible to reduce a risk that the mist of the first liquid ejected toward the first rotating body 112 is attached to the circumferential surface 211 of the second rotating body 212. When the liquid ejecting unit 14 performs flushing, it is possible to reduce a risk that the mist of the second liquid ejected toward the second rotating body 212 is attached to the circumferential surface 111 of the first rotating body 112. In summary, it is possible to reduce a risk that the mist of the second liquid is attached to the circumferential surface 111 of the first rotating body 112 or the mist of the first liquid is attached to the circumferential surface 211 of the second rotating body 212 and thereby the first liquid and the second liquid are mixed together.

(5) The first suction opening 118 is arranged at a position between the ejection area PA and the first rotating body 112 in the width direction X. Therefore, the mist of the first liquid and the second liquid ejected from the liquid ejecting unit 14 in the ejection area PA can be sucked from the first suction opening 118. As a result, when the liquid ejecting unit 14 performs printing on the medium ST in the ejection area PA, it is possible to reduce a risk that the mist of the second liquid ejected toward the medium ST is attached to the circumferential surface 111 of the first rotating body 112. When the liquid ejecting unit 14 performs printing on the medium ST in the ejection area PA, it is possible to reduce a risk that the mist of the first liquid ejected toward the medium ST is attached to the circumferential surface 211 of the second rotating body 212. In summary, it is possible to reduce a risk that the mist of the second liquid is attached to the circumferential surface 111 of the first rotating body 112 or the mist of the first liquid is attached to the circumferential surface 211 of the second rotating body 212 and thereby the first liquid and the second liquid are mixed together.

(6) The first rotating body 112 and the second rotating body 212 are arranged in positions shifted from each other in the transport direction Y so as to correspond to the first nozzle group 41 and the second nozzle group 42. Therefore, as compared with a configuration in which the first rotating body 112 and the second rotating body 212 are arranged at the same position in the transport direction Y, it is possible to increase a distance between the first rotating body 112 and the second rotating body 212, and thereby it is possible to reduce a risk that the first liquid and the second liquid are mixed together.

(7) The first rotating body 112 and the second rotating body 212 rotate so that the circumferential surfaces 111 and 211 that receive the first liquid and the second liquid, respectively, move in the transport direction Y in which the medium ST is transported. Therefore, it is possible to preferably employ the first rotating body 112 and the second rotating body 212 as rotating bodies that receive liquids.

(8) In the first rotating body 112, the circumferential surface 111 that receives liquid rotates in a direction being away from the second rotating body 212. Therefore, it is possible to reduce a risk that the mist of the first liquid is flowed toward the second rotating body 212 by a flow of gas generated by rotation of the first rotating body 112.

(9) The first liquid is a treatment liquid that facilitates fixing of the second liquid to the medium ST, so that it is possible to preferably employ the first liquid when fixing the second liquid by using a treatment liquid.

(10) The first and the second rotating bodies 112 and 212 are formed of belt-like members, so that the receiving surfaces 117 and 217 can be flat surfaces as compared with a case in which the first and the second rotating bodies 112 and 212 are formed of rollers. The receiving surfaces 117 and 217 are made into flat surfaces, so that it is possible to reduce gaps between the liquid ejecting unit 14 and the first and the second rotating bodies 112 and 212. Therefore, it is possible to reduce occurrence of the mist of the first and the second liquids.

(11) The moisture in the storage chambers 134 and 234 of the first and the second rotating body holders 110 and 210 is maintained by the first and the second liquids collected in the first and the second collection units 153 and 253. Thereby, it is possible to suppress drying of the first and the second liquids attached to the first and the second rotating bodies 112 and 212, so that it is possible to reduce a risk that liquid is fixed to the circumferential surfaces 111 and 211 by drying.

(12) While the first suction opening 118 mainly sucks the mist of the first liquid, the first suction opening 118 may also suck floating mist of the second liquid. Therefore, the first and the second liquids may chemically react with each other in the first filter material 89 to be fixed. While the second suction opening 218 mainly sucks the mist of the second liquid, the second suction opening 218 may also suck floating mist of the first liquid. Therefore, the first and the second liquids may chemically react with each other in the second filter material 90 to be fixed. In this respect, the first and the second filter materials 89 and 90 of the present embodiment are provided in the filter cassette 85 that can be detachably attached to the collection box 80. Thereby, it is possible to appropriately replace the first and the second filter materials 89 and 90, whose mist capturing performances have degraded, along with the filter cassette 85.

The embodiment described above may be changed as described below. The modified examples below may be appropriately combined together. The second rotating body 212 may have a configuration in which the receiving surface 217, to which the second liquid is ejected, of the circumferential surface 211 rotates toward the downstream side in the transport direction Y. In other words, the second rotating body 212 may have a configuration in which the second rotating body 212 may rotate in a direction being away from the first rotating body 112 in the transport direction Y. In this case, it is possible to reduce a risk that the mist of the second liquid is flowed toward the first rotating body 112 by a flow of gas generated by rotation of the second rotating body 212.

The first rotating body 112 may have a configuration in which the receiving surface 117, to which the first liquid is ejected, of the circumferential surface 111 rotates toward the downstream side in the transport direction Y. The first and the second rotating bodies 112 and 212 may have a configuration in which the circumferential surfaces 111 and 211 move in the width direction X.

The first and the second suction openings 118 and 218 may have configurations different from those of the first and the second receiving portions 100 and 200. The driving rollers 115 and 215 need not have diameters greater than those of the driven rollers 116 and 216. For example, the driving rollers 115 and 215 may have diameters smaller than those of the driven rollers 116 and 216 or may have the same diameters as those of the driven rollers 116 and 216.

Moisturizing liquids that moisturizes the first and second liquids may be supplied to the first and the second collection units 153 and 253 through the connection portions 156 and 256 of the first and the second collection units 153 and 253. Thereby, the insides of the storage chambers 134 and 234 of the first and the second rotating body holders 110 and 210 are moisturized by the moisturizing liquids. Therefore, it is possible to suppress drying of the first and the second liquid attached to the first and the second rotating bodies 112 and 212, so that it is possible to further reduce the risk that liquid is fixed to the circumferential surfaces 111 and 211 by drying.

The first and the second rotating bodies 112 and 212 may be formed of a rotatable roller instead of a belt-like member such as a belt. In this case, it is preferable that the rotary shaft of the roller is provided in the same direction as a direction in which the nozzle array 43 extends. One of the first and the second rotating bodies 112 and 212 may be formed of a belt-like member, and the other may be formed of a roller.

The liquid ejecting apparatus 11 may include a third rotating body in addition to the first rotating body 112 and the second rotating body 212. In other words, the liquid ejecting apparatus 11 may include three or more receiving portions, which can receive liquids ejected by flushing, according to types of liquids ejected by the liquid ejecting unit 14.

The first liquid may be a post-treatment liquid that is ejected to the medium ST to which the second liquid has been ejected. In this case, the first receiving portion 100 including the first rotating body 112 is preferred to be located on the downstream side of the second receiving portion 200 including the second rotating body 212.

The first rotating body 112 and the second rotating body 212 may be arranged to be completely overlapped with each other in the transport direction Y. It is preferable that the first and the second rotating bodies 112 and 212 are arranged to correspond to the arrangement of the first and the second liquid ejecting heads 26 and 27. However, first and the second rotating bodies 112 and 212 need not be arranged to correspond to the arrangement.

The filter cassette 85 may be configured so that the first filter material 89 and the second filter material 90 can be detachably attached to the frame body 88. The first and the second liquid ejecting heads 26 and 27 may be arranged so as not to be overlapped with each other in the transport direction Y.

When the liquid ejecting unit 14 performs flushing on the circumferential surfaces 111 and 211 in a state in which the rotation of the first and the second rotating bodies 112 and 212 is stopped, it is preferable that the rotation of the first and the second rotating bodies 112 and 212 thereafter is performed when the liquid ejecting unit 14 is located at a position where the liquid ejecting unit 14 performs flushing or at a timing when the liquid ejecting unit 14 does not eject liquid to the medium ST in the ejection area PA.

In a state in which the first and the second rotating bodies 112 and 212 are rotated, the first and the second liquids may be ejected to the circumferential surfaces 111 and 211 from the liquid ejecting unit 14 as the flushing. Driving sources for driving the driving rollers 115 and 215 of the first and the second receiving portions 100 and 200 may be provided to the driving rollers 115 and 215, respectively.

The collection box 80 and the suction fan 81 may be provided for each of the first and the second suction openings 118 and 218 of the first and the second rotating body holders 110 and 210. Further, suction timings from the first and the second suction openings 118 and 218 may be differentiated from each other. Further, when the flushing is performed, suction from only one suction opening, for example, suction from only the second suction opening 218, may be performed.

When the liquid ejecting unit 14 performs printing by ejecting liquid to the medium ST in the ejection area PA, it is possible to perform suction from at least one of the first and the second suction openings 118 and 218, for example, suction from the first suction opening 118. Further, in this case, suction strength may be controlled to be weaker than that from the suction opening during flushing by controlling driving of the suction fan.

Drying of the liquid attached to the medium ST may be facilitated by arranging the heat generating unit 15 on the downstream side of the moving area of the carriage 25 in the transport direction Y. It is possible not to include the heat generating unit 15.

In the embodiment described above, the liquid ejecting apparatus may be a liquid ejecting apparatus that ejects and discharges a liquid other than ink as the second liquid. A shape of the liquid that is ejected as a minute droplet from the liquid ejecting apparatus may be a granular shape, a tear-drop shape, and a shape that leaves a tail like a string. The liquid mentioned here may be any kind of material that can be ejected from the liquid ejecting apparatus. For example, the liquid may be any material that is in a liquid phase, and examples thereof include fluids such as a liquid body having a high or low viscosity, a sol, gel water, another inorganic solvent, an organic solvent, a solution, a liquid resin, and a liquid metal (metal melt). Furthermore, the examples include not only liquid, as one state of materials, but also materials in which solvent contains dissolved, dispersed, or mixed particles of a functional material made of a solid, such as pigments or metal particles. Representative examples of the liquid include ink such as that described in the foregoing embodiment, liquid crystal, or the like. Here, "ink" encompasses general water-based ink and oil-based ink, as well as various types of liquid compositions such as gel ink and hot melt-ink. As a specific example of the liquid ejecting apparatus, there is a liquid ejecting apparatus that ejects liquid containing materials, such as electrode materials and color materials used for manufacturing, for example, a liquid crystal display, an EL (electroluminescence) display, a surface emitting display, a color filter, and the like, in a dissolved form or a dispersed form. Further, the liquid ejecting apparatus may be a liquid ejecting apparatus that ejects bioorganic substances used for manufacturing biochips, a liquid ejecting apparatus which is used as a precision pipette and ejects liquid that is to be a sample, a printing apparatus, a micro dispenser, and the like. Further, the liquid ejecting apparatus may be a liquid ejecting apparatus which ejects lubricant with pinpoint accuracy to a precision machine such as a watch or a camera, and a liquid ejecting apparatus which ejects a transparent resin liquid such as a UV-curing resin in order to form a micro-hemispherical lens (optical lens) used for optical communication elements or the like onto a substrate. Further, the liquid ejecting apparatus may be a liquid ejecting apparatus that ejects an acid etching liquid, an alkaline etching liquid, or the like in order to etch a substrate or the like.

The entire disclosure of Japanese Patent Application No. 2017-034471, filed Feb. 27, 2017, is expressly incorporated by reference herein.

What is claimed is:

1. A liquid ejecting apparatus comprising:

a liquid ejecting unit that is configured to eject a first liquid and a second liquid onto a medium that is supported by a support member;

a first reception member configured to receive the first liquid ejected from the liquid ejecting unit;

a first sliding contact member configured to be in sliding contact with the first reception member;

a first collection unit that collects the first liquid that is collected from the first reception member by the first sliding contact member;

a second reception member configured to receive the second liquid ejected from the liquid ejecting unit;

a second sliding contact member configured to be in sliding contact with the second reception member; and a second collection unit that collects the second liquid that is collected from the second reception member by the second sliding contact member wherein the support member is different from the first and second reception members.

2. The liquid ejecting apparatus according to claim 1, further comprising:

a first attaching unit including the first collection unit;

a first reception member holder which holds the first reception member and the first sliding contact member and which can be detachably attached to the first attaching unit;

a second attaching unit including the second collection unit; and a second reception member holder which holds the second reception member and the second sliding contact member and which can be detachably attached to the second attaching unit.

3. The liquid ejecting apparatus according to claim 1, wherein the first reception member and the second reception member are belt-like members which are laid over a plurality of rollers and rotate around the rollers.

4. The liquid ejecting apparatus according to claim 1, further comprising:

a suction port configured to suck air facing the liquid ejecting unit at a position between the first reception member and the second reception member in a direction crossing a transport direction in which the medium is transported.

5. The liquid ejecting apparatus according to claim 1, wherein the first reception member and the second reception member are provided in a maintenance area located outside an ejection area where the liquid ejecting unit ejects at least one of the first liquid and the second liquid to the medium in a direction crossing a transport direction in which the medium is transported, in the maintenance area, the first reception member is arranged closer to the ejection area than the second reception member, and the liquid ejecting apparatus includes a first suction opening configured to suck air facing the liquid ejecting unit at a position between the ejection area and the first reception member in the direction crossing the transport direction.

6. The liquid ejecting apparatus according to claim 1, wherein the liquid ejecting unit has a first nozzle group that ejects the first liquid and a second nozzle group that ejects the second liquid in positions shifted from each other in a transport direction in which the medium is transported, and the first reception member and the second reception member are arranged in positions shifted from each other in the transport direction so as to correspond to the first nozzle group and the second nozzle group.

7. The liquid ejecting apparatus according to claim 1, wherein reception surfaces of the first reception member and the second reception member, which receive the first liquid and the second liquid respectively, move in a transport direction in which the medium is transported.

8. The liquid ejecting apparatus according to claim 1, wherein in the first reception member, the reception surface that receives the first liquid moves in a direction being away from the second reception member.

9. The liquid ejecting apparatus according to claim 1, wherein the first liquid is a treatment liquid that facilitates fixing of the second liquid to the medium.

10. A liquid ejecting apparatus comprising:

a liquid ejecting unit configured to eject a first liquid and a second liquid to a medium on a support member;

a first reception member configured to receive the first liquid ejected from the liquid ejecting unit;

a first contact member configured to be in contact with the first reception member;

a first reception member holding portion which holds the first reception member and the first contact member, the first reception member holding portion having a first discharge port configured to discharge the first liquid collected from the first reception member by the first contact member;

a first collection portion that collects the first liquid discharged from the first discharge port of the first reception member holding portion;

a second reception member configured to receive the second liquid ejected from the liquid ejecting unit;

a second contact member configured to be in contact with the second reception member;

a second reception member holding portion which holds the second reception member and the second contact member, the second reception member holding portion having a second discharge port configured to discharge the second liquid collected from the second reception member by the second contact member; and a second collection portion that collects the second liquid discharged from the second discharge port of the second reception member holding portion, wherein the first reception member and the second reception member are located outside an ejection area where the liquid ejecting unit ejects at least one of the first liquid and the second liquid to the medium in a cross direction crossing a transport direction in which the medium is transported, wherein the first reception member and the second reception member are disposed at interval in the cross direction, and the first discharge port and the second discharge port are disposed at interval in the cross direction and disposed shifted from each other in the transport direction.

11. The liquid ejecting apparatus according to claim 10, wherein the first collection portion includes a first collection port configured to receive the first liquid discharged from the first discharge port, and the second collection portion includes a second collection port configured to receive the second liquid discharged from the second discharge port, wherein the first collection port and the second collection port are disposed at interval in the cross direction and disposed shifted from each other in the transport direction.

12. The liquid ejecting apparatus according to claim 11, wherein a tip of the first contact member is located directly above the first collection port in a gravity direction, and a tip of the second contact member is located directly above the second collection port in the gravity direction.

13. The liquid ejecting apparatus according to claim 12, wherein the first contact member is in sliding contact with the first reception member, and the second contact member is in sliding contact with the second reception member.

14. The liquid ejecting apparatus according to claim 13, wherein the first reception member and the second reception member are belt-like members which are laid over a plurality of rollers and rotate around the rollers.

15. The liquid ejecting apparatus according to claim 10, wherein the liquid ejecting unit has a first nozzle group that ejects the first liquid and a second nozzle group that ejects the second liquid, wherein the second nozzle group includes a plurality of nozzle arrays where two nozzle arrays located close to each other in the cross direction are arranged at intervals.

16. The liquid ejecting apparatus according to claim 10, wherein the liquid ejecting unit has a first nozzle group that ejects the first liquid and a second nozzle group that ejects the second liquid in positions shifted from each other in the transport direction, and the first reception member and the second reception member are arranged shifted from each other in the transport direction so as to correspond to the first nozzle group and the second nozzle group.

17. The liquid ejecting apparatus according to claim 10, wherein the first liquid is a treatment liquid that facilitates fixing of the second liquid to the medium.

* * * * *